US010505272B2

(12) United States Patent
Anguera Pros et al.

(10) Patent No.: US 10,505,272 B2
(45) Date of Patent: Dec. 10, 2019

(54) MULTI-STRUCTURE ANTENNA FOR MULTIBAND OPERATION

(71) Applicant: Fractus Antennas, S.L., Barcelona (ES)

(72) Inventors: Jaume Anguera Pros, Vinaros (ES); Aurora Andujar Linares, Barcelona (ES)

(73) Assignee: Fractus Antennas, S.L., Barcelona (ES)

( * ) Notice: Subject to any disclaimer, the term of this patent is extended or adjusted under 35 U.S.C. 154(b) by 0 days.

(21) Appl. No.: 16/433,744

(22) Filed: Jun. 6, 2019

(65) Prior Publication Data

US 2019/0288386 A1 Sep. 19, 2019

Related U.S. Application Data

(63) Continuation of application No. 15/415,557, filed on Jan. 25, 2017, now Pat. No. 10,347,983.
(Continued)

(51) Int. Cl.
*H01Q 1/48* (2006.01)
*H01Q 1/24* (2006.01)
(Continued)

(52) U.S. Cl.
CPC ..... *H01Q 1/48* (2013.01); *H01Q 1/24* (2013.01); *H01Q 1/241* (2013.01); *H01Q 1/243* (2013.01); *H01Q 5/371* (2015.01); *H01Q 5/50* (2015.01)

(58) Field of Classification Search
CPC ..... H01Q 1/48; H01Q 1/243; H01Q 1/241; H01Q 1/24; H01Q 5/371; H01Q 5/50
See application file for complete search history.

(56) References Cited

U.S. PATENT DOCUMENTS

2014/0340276 A1* 11/2014 Anguera Pros ..... H01Q 1/243 343/843
2016/0028152 A1 1/2016 Anguera Pros et al.
2016/0111790 A1* 4/2016 Anguera Pros ..... H01Q 1/38 343/700 MS

FOREIGN PATENT DOCUMENTS

WO 2010015364 2/2010
WO 2010015365 2/2010
(Continued)

OTHER PUBLICATIONS

Wong, Kin-Lu; et al., A Low-Profile Planar Monopole Antenna for Multiband Operation of Mobile Handsets, IEEE Transactions on Antennas and Propagation, p. 121-125, vol. 51, No. 1, Jan. 2003.
(Continued)

*Primary Examiner* — Hai V Tran
(74) *Attorney, Agent, or Firm* — Edell, Shapiro & Finnan, LLC.

(57) ABSTRACT

A wireless device operates in multiple frequency bands via a multi-structure arrangement that optimizes the electromagnetic performance at each frequency range of operation. The device includes a radiating system comprising a ground plane layer, a multi-structure antenna system that comprises at least two structural branches and at least a radiation booster, and a radiofrequency system. The radiofrequency system comprises an element inserted in the branch structure, connected at a point within the structure. The radiofrequency system may include an additional matching network that fine tunes the impedance of the device to match all the frequency ranges of operation.

16 Claims, 5 Drawing Sheets

Related U.S. Application Data

(60) Provisional application No. 62/286,469, filed on Jan. 25, 2016.

(51) Int. Cl.
*H01Q 5/50* (2015.01)
*H01Q 5/371* (2015.01)

(56) References Cited

FOREIGN PATENT DOCUMENTS

| | | |
|---|---|---|
| WO | 2014012796 | 1/2014 |
| WO | 2014012842 | 1/2014 |

OTHER PUBLICATIONS

Fujimoto, K., Antennas for mobile communications, Encyclopedia of RF and Microwave Engineering, John Wiley & Sons, Apr. 15, 2005, p. 334-337.

* cited by examiner

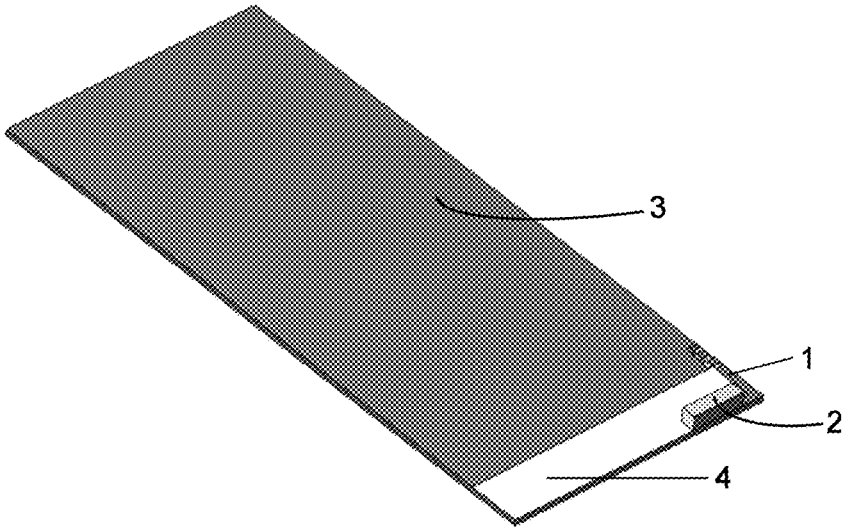
FIG. 1 – PRIOR ART
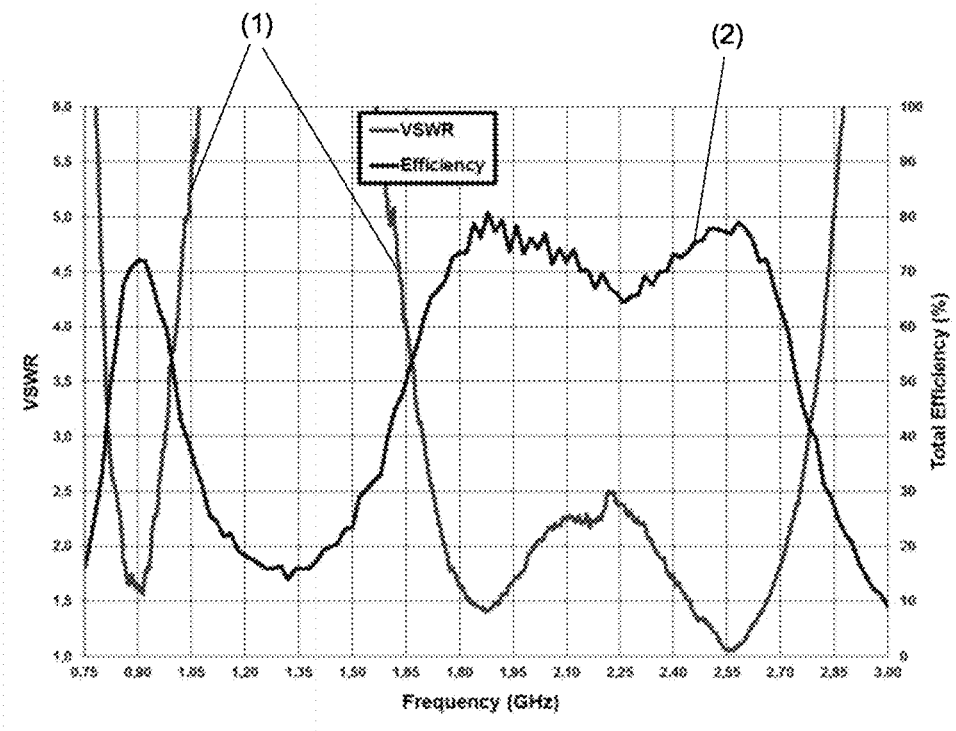
FIG. 2

MULTI-STRUCTURE ANTENNA FOR MULTIBAND OPERATION

CROSS REFERENCE TO RELATED APPLICATIONS

This application is a continuation of U.S. patent application Ser. No. 15/415,557 filed Jan. 25, 2017, which claims priority under 35 U.S.C. § 119(e) from U.S. Provisional Patent Application Ser. No. 62/286,469 filed Jan. 25, 2016, the entire contents of which are hereby incorporated by reference.

TECHNICAL FIELD

A wireless device operates in multiple frequency bands via a multi-structure arrangement that optimizes the electromagnetic performance at each frequency range of operation. The device includes a radiating system comprising a ground plane layer, a multi-structure antenna system that comprises at least two structural branches and at least a radiation booster, and a radiofrequency system. The radiofrequency system comprises an element inserted in the branch structure, connected at a point within the structure. The radiofrequency system may include an additional matching network that fine tunes the impedance of the device to match all the frequency ranges of operation.

BACKGROUND

Most wireless devices feature a customized antenna, i.e., an antenna that is designed and manufactured ad-hoc for each device model. This is because each wireless device or, more specifically, each mobile device features a different radioelectric specification and a different internal architecture. Additionally, one of the main requirements demanded of antenna technology developed for wireless devices is to feature reduced dimensions since the available space for the antenna system in such devices is quite small. Consequently, one of the constrains of some antenna technologies when they have to be applied to wireless devices is their size, since the relationship between antenna size and its operating wavelength results in large sizes when small frequency bands need to be covered, such as LTE700, GSM850 or GSM900 in the case of mobile communications. In order to fulfill size requirements, antenna technology has evolved to provide complex antenna architectures that efficiently occupy and make use of the maximum space available inside the device, especially if this is a mobile device, a smartphone and the like.

Since the need for covering more applications is an increasing demand of wireless devices, other requirements related to such devices are large bandwidths and high efficiencies in order to provide good wireless communications. The challenge then is to develop antenna technologies that provide large bandwidths with good antenna efficiencies and that feature reduced sizes to fit in the small available spaces that wireless devices dedicate to the antenna system. One finds in the prior art some solutions proposed to fulfill the mentioned requirements. FIG. 1 shows a prior-art example (WO 2010/015365 A2) that illustrates a solution that provides multiband operation covering two different frequency regions. This solution comprises one structural branch that normally includes a strip line 1 and a radiation booster 2 connected to an end of the strip branch. This single-branch antenna structure protrudes from a ground plane layer 3 that comprises a ground clearance 4 that allocates the antenna structure. Normally, a single-branch solution like the one in FIG. 1 uses a single matching network, such as the one provided in FIG. 3, to match the input impedance of the device and to provide bandwidth at the different frequency bands and/or regions of operation. FIG. 2 displays the bandwidth (1) and the efficiency (2) computed for the example shown in FIG. 1. These curves are obtained by using a typical Electromagnetic CAD tool (e.g., IE3D). Curve (1) shows a two-region bandwidth covering the frequency ranges that go from 824 MHz to 960 MHz and from 1,710 MHz to 2,690 MHz. Curve (2) provides the antenna efficiency related to the mentioned example. The limitations of a single-branch solution emerge when one wants to improve the electromagnetic performance of the device, particularly at low frequency ranges.

Other prior-art solutions comprise an antenna system that includes more than one single-branch structure and a feeding system for each structure, or branch in these cases. Other solutions found in the prior art operate by coupling between branches of their single-branch structures. More details of those solutions are found in WO 2014/012796 A1 and US 2016/0111790 A1, respectively. In general, the solutions that include more than one single-branch structure provide better bandwidths than single-branch solutions but one of their drawbacks is that they feature radiofrequency systems more complex in architecture and in the number of ports. One also may find multi-branch solutions with simpler radiofrequency systems but those can not reach so large bandwidths as the aforementioned solutions and a device related to the system described herein.

SUMMARY

It is the purpose of the described system to provide a wireless device solution that fulfills the electromagnetic requirements at the different frequency regions of operation via a multi-structure multi-branch antenna system that enables optimization of the performance at each frequency region and/or band separately, improving the operation bandwidth and the efficiencies achieved. Additionally, the multi-branch solution features a common feeding system for the whole multi-branch structure, providing a simpler feeding system and normally also a simpler radiofrequency structure than the prior-art solutions that comprise more than one single-branch structures. The described system also profits from the advantages of VATech technology as described in WO 2010/015365 A2, such as for example small antenna system volume and standardization.

Different applications can be covered by a wireless device related to the described system, including mobile, Wifi, Bluetooth or even Sharkfin applications. It is an object of the described system to provide a wireless device that operates at different frequency band and/or regions via a multi-structure arrangement comprising different structural branches, which operate independently at the different given frequency regions and/or bands of operation, a structural branch being a conductive path.

BRIEF DESCRIPTION OF THE DRAWINGS

FIG. 1 shows an example that illustrates a single-branch solution typical of a prior-art device.

FIG. 2 shows the VSWR and the efficiency curves related to the prior-art example provided in FIG. 1.

DETAILED DESCRIPTION

Figure 3:
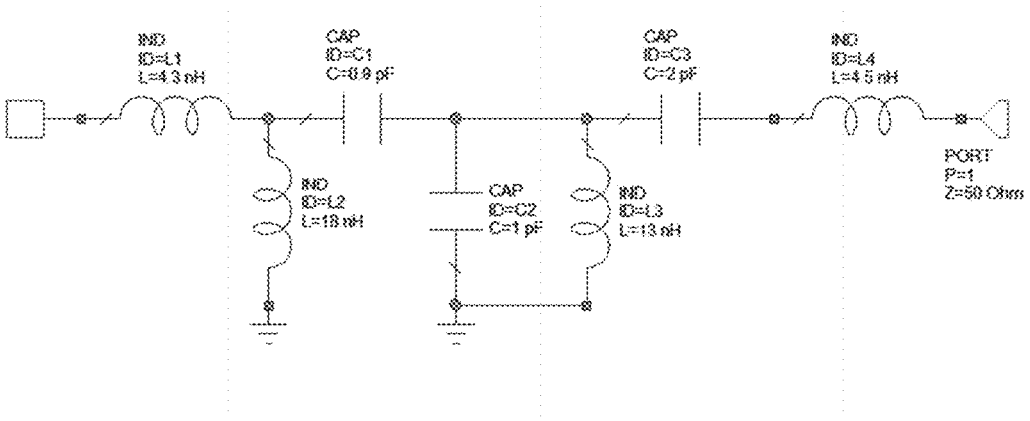
FIG. 3 provides the matching network used to match the prior-art example from FIG. 1.
Figure 4:
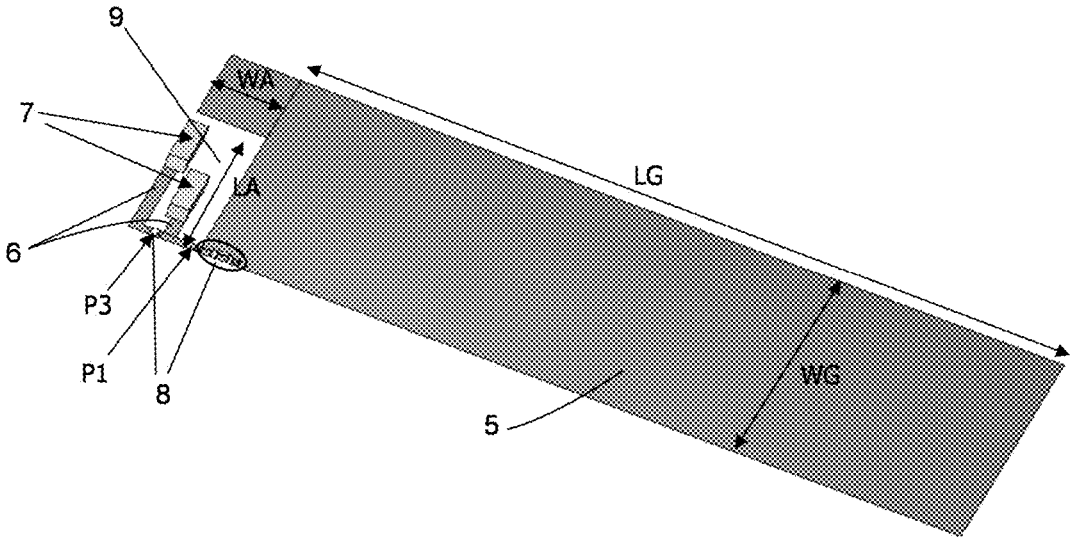
FIG. 4 provides an embodiment of the described system that comprises an antenna system comprising two conductive branches, each one connected at an end to a radiation booster.

In this section, illustrative examples of the described system are provided in detail with no limiting purpose. Referring to FIG. 4, a wireless device according to the described system includes a radiating system that comprises a ground plane layer 5, a multi-structure antenna system that comprises at least two structural branches 6 and at least a radiation booster 7, and a radiofrequency system 8. The antenna system is generally allocated in a clearance area 9 of the mentioned ground plane layer 5. The antenna system is connected to the radiofrequency system and each branch of the antenna system is normally connected at an end to one of the radiation boosters. Examples of radiation booster elements are for instance those described in WO2010015365 A2, WO2010015364 A2, WO2014012842 A1 and U.S. patent application Ser. No. 14/807,449 and 62/152,991, incorporated by reference herein in their entireties. Examples of commercial booster elements suitable for the described system are for instance Fractus® mXTEND, mXTEND RUN and mXTEND BAR range of products. The radiofrequency system comprises an element inserted within the branch structure. The element normally is a decoupler mechanism. In some embodiments, such element is a filter. The radiofrequency system normally includes an additional matching network that fine tunes the impedance of the device to match all the frequency ranges of operation.

Figure 5:
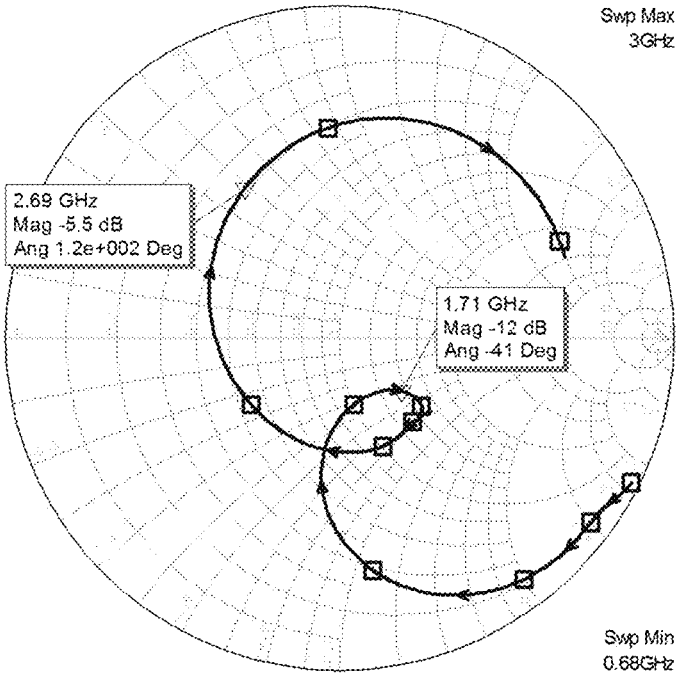
FIG. 5 shows the reflection coefficient in Smith Chart representation at port P1 when port P3 is open circuit.
Figure 6:
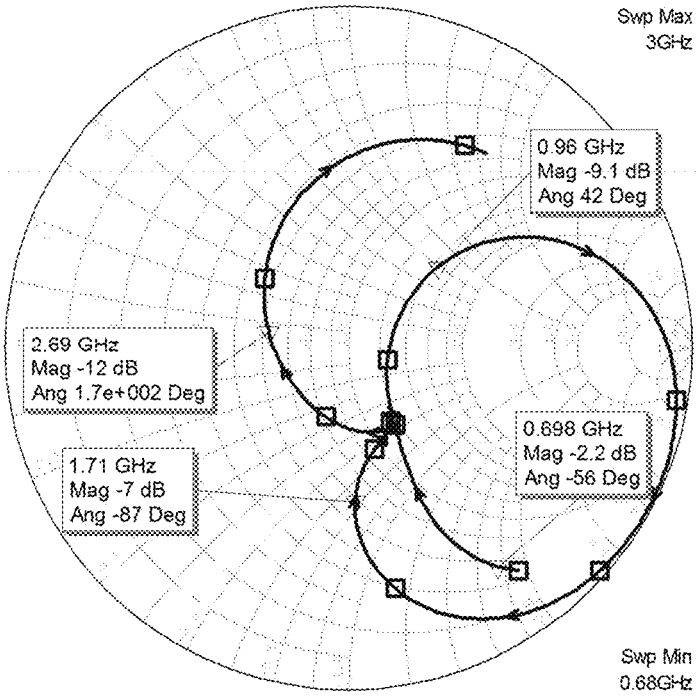
FIG. 6 shows the reflection coefficient in Smith Chart representation at port P1 when port P3 includes a filter.

As previously mentioned, each branch mainly contributes to the performance of one frequency band and/or region of operation. FIG. 5 shows the input reflection coefficient at port P1 when port P3 is open circuit, for a two-branch example, like the one pictured in FIG. 4. More concretely, the input reflection coefficient corresponds to the HFR branch when the other is not connected. FIG. 6 shows how the other branch allows resonance at LFR frequencies when it is connected through port P3, while the impedance and matching of the HFR frequency bands are not considerably changed. In the case of FIG. 6 the input reflection coefficient is obtained when the LFR branch is connected through a filter at port P3. It has been found that each conductive branch path can be optimized to provide operation in a given frequency region and/or band, providing optimized performance.

Depending on the application of the wireless device, the ground plane dimensions of a device related to the described system are typically between 60 mm and 300 mm in length LG and between 30 mm and 240 mm in width WG, but not limited to those dimensions, or preferably between 100 mm and 200 mm in length and between 60 mm and 150 mm in width, or yet preferably between 110 mm and 150 mm and between 60 mm and 90 mm for the ground plane length and width respectively. The area that the antenna system of a device related to this system fills, normally features a length LA between 10 mm and 100 mm and a width WA between 5 mm and 30 mm, or preferably between 15 mm and 60 mm and between 8 mm and 20 mm for the area length and width respectively, or even preferably between 20 mm and 30 mm for length and between 10 mm and 15 mm for width, those dimensions depending on the operation wavelengths.

Figure 7:
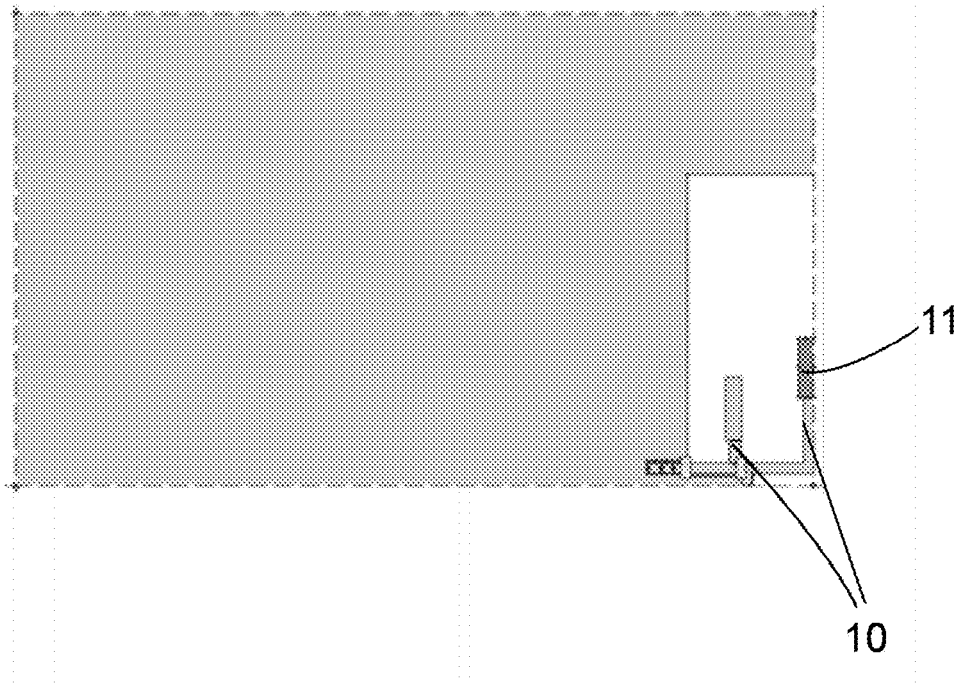
FIG. 7 provides an example that comprises two branches but just one is connected at an end to a radiation booster.

Some embodiments related to the described system include only one radiation booster even if the antenna system comprises more than one branch. FIG. 7 presents an example that comprises two branches 10, with just one including a radiation booster 11 at one end.

Other examples related to the described system include an antenna system that comprises two branch paths with two radiation boosters connected at an end of each conductive branch, which operates at two different frequency bands and/or regions, like for example the embodiment provided in FIG. 4. Typically, an example of these characteristics operates within a first frequency range going from 600 MHz to 1 GHz and within a second frequency range that goes from 1,710 MHz to 3,000 MHz.

In some embodiments, the multi-structure arrangement includes three conductive branch paths and three radiation boosters, each conductive path connected at an end to a radiation booster. Such embodiments normally operate at three different frequency regions and/or bands, such for example a first range of frequencies within 600 MHz and 1 GHz range, a second range of frequencies within the 1,700 MHz and 3,000 MHz range and a third frequency range where the lowest frequency is bigger than the largest frequency of the second frequency range of operation.

Figure 8:
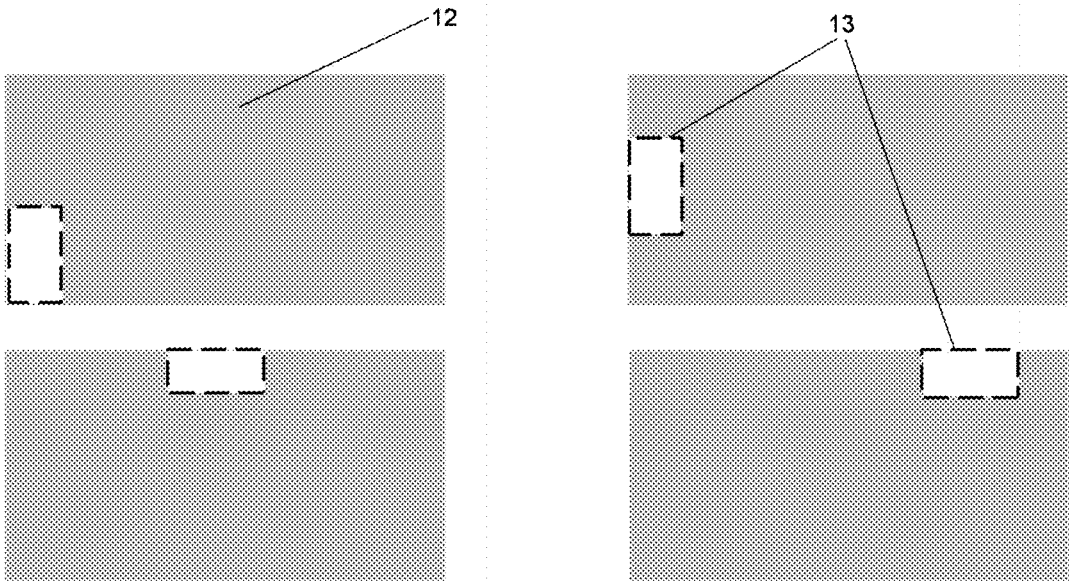
FIG. 8 shows examples including a ground clearance at different positions on the ground plane layer.

Some other examples comprise a ground clearance that allocates the multi-structure antenna system, not positioned at a corner of the ground plane layer 12 but at other locations. Some other embodiments include such ground clearance at a corner position of the ground plane layer. FIG. 8 provides different examples where the clearance is located at different positions on the ground plane layer. Those clearance positions are indicated with a dashed box 13 in FIG. 8.

Figure 9:
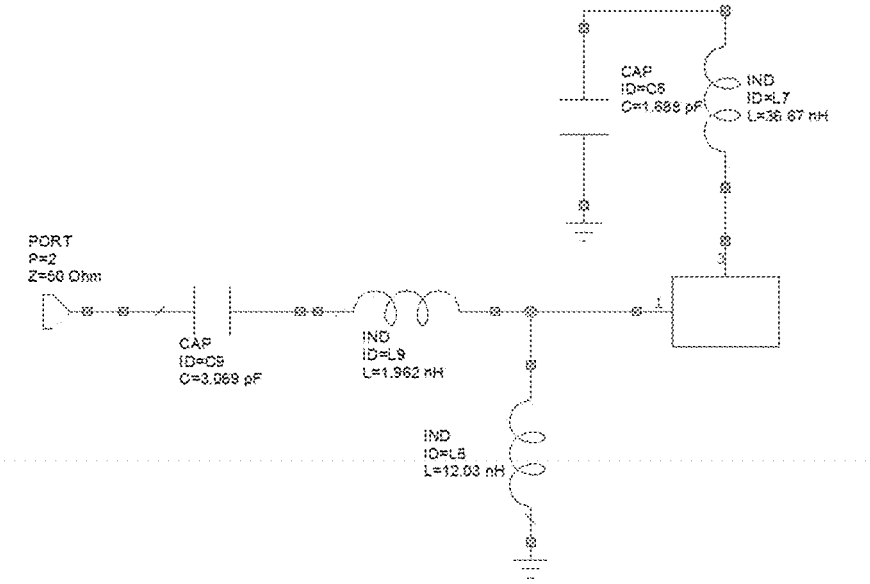
FIG. 9 provides the matching network comprised in the radiofrequency system of the embodiment provided in FIG. 4.

FIG. 4 shows a two-branch embodiment and is described in more detail. Such embodiment comprises a radiating system that contains a ground plane layer of 120×60 mm2, a multi-structure antenna system that includes two structural branches connected at an end to two radiation boosters, each branch to one radiation booster, and a radiofrequency system connected at an end to the multi-branch antenna system. More concretely, in this example, each branch path comprises a conductive strip which is connected to a RUN mXTEND radiation booster (12×3×2.4 $mm^3$ dimensions). This two-branch system is placed in a clearance area of dimensions 11×40 $mm^2$ positioned at a corner of the ground plane layer (FIG. 4). The described antenna system fills an area of 11×33 $mm^2$, including the booster element. For this specific embodiment, the radiofrequency element or component inserted between branches is a filter implemented with a parallel LC components combination. FIG. 9 shows such LC filter connected at port 3. Also, a matching network is included in the radiofrequency system at port 1 to match the target LFR and HFR bands of operation. A three-components matching network is used, and its topology is shown in FIG. 9. For this specific example, with the structure described, the longer branch path mainly contributes to LFR operation while the shorter branch mainly contributes to HFR.

Figure 10:
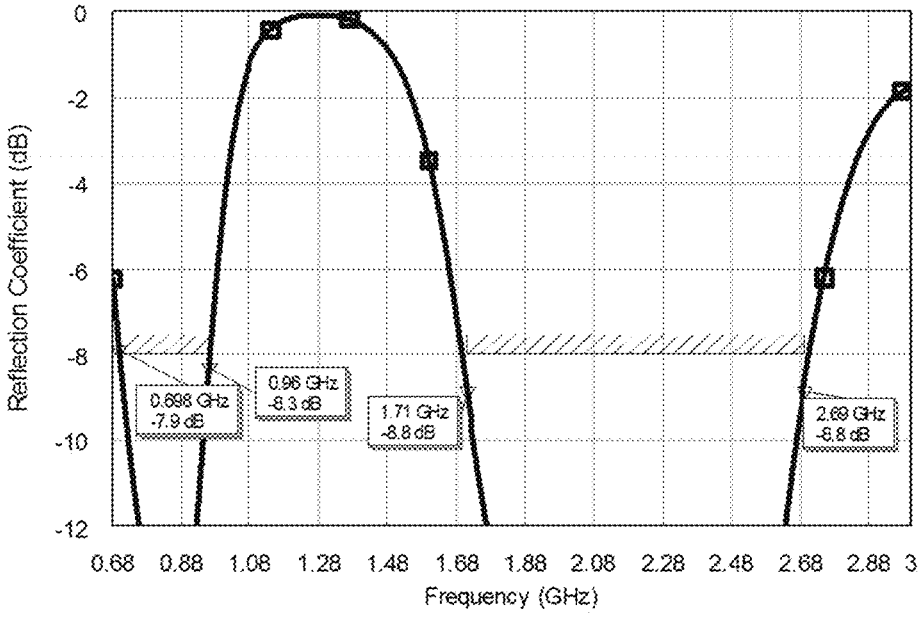
FIG. 10 provides the reflection coefficient related to the example illustrated in FIG. 4 and matched with the matching network from FIG. 9.

Referring to FIG. 9, the matching network and filter included in the radiofrequency system used to match the embodiment presented in FIG. 4 is provided. The topology comprises a parallel LC circuit at port 3 used as filter, and a three components matching network, including a parallel inductance, a series inductance and a series capacitor, implemented at port 1. The values of the components are also included in the picture provided. FIG. 10 provides the reflection coefficient related to the embodiment described before and shown in FIG. 4. It provides operation at both LFR and HFR, more specifically from 698 MHz to 960 MHz range and from 1.71 GHz to 2.69 GHz frequency range. The frequency ranges are matched with a reflection coefficient below −8 dB in the bands.

What is claimed is:

1. A wireless device comprising:

a radiating system comprising:

a ground plane layer shaped to provide a clearance area in a cutout that extends into the ground plane layer along a perimeter thereof;

a radiofrequency system; and a multi-structure antenna system disposed in the clearance area and comprising:

a branch structure comprising: a common conductive strip connected to the radiofrequency system and having first and second ends, wherein a distance between the first end of the common conductive strip and a nearest point on the ground plane layer to the first end of the common conductive strip is less than a distance between the second end of the common conductive strip and a nearest point on the ground plane layer to the second end of the common conductive strip; a first conductive branch extending from the common conductive strip into the clearance area; and a second conductive branch extending from the common conductive strip into the clearance area; and a first radiation booster connected to the first conductive branch, wherein the radiating system is configured to operate in more than one frequency band.

2. The wireless device of claim 1, wherein the first and second conductive branches comprise conductive strips.

3. The wireless device of claim 1, wherein the radiofrequency system comprises a filter disposed within the branch structure.

4. The wireless device of claim 1, wherein the clearance area extends into a corner of the ground plane layer, and wherein the first radiation booster is connected to an end of the first conductive branch.

5. The wireless device of claim 1, wherein the multi-structure antenna system further comprises a second radiation booster connected to the second conductive branch, and wherein the radiating system is configured to operate within a frequency range of 600 MHz to 3,000 MHz.

6. The wireless device of claim 1, wherein the multi-structure antenna system further comprises a third conductive branch extending from the common conductive strip into the clearance.

7. The wireless device of claim 1, wherein the first conductive branch extends from a first point on the common conductive strip and the second conductive branch extends from a second point on the common conductive strip that is different from the first point.

8. The wireless device of claim 1, wherein the first and second conductive branches have different lengths to facilitate operation in more than one frequency band.

9. A wireless device comprising:

a radiating system comprising:

a ground plane layer shaped to provide a clearance area in a cutout that extends into the ground plane layer along a perimeter thereof; and a multi-structure antenna system disposed in the clearance area and comprising:

a branch structure comprising: a common conductive strip connected to the radiofrequency system and having first and second ends, wherein a distance between the first end of the common conductive strip and a nearest point on the ground plane layer to the first end of the common conductive strip is less than a distance between the second end of the common conductive strip and a nearest point on the ground plane layer to the second end of the common conductive strip;

a plurality of conductive branches extending from the common conductive strip into the clearance area; and a respective plurality of radiation boosters, each of the conductive branches being connected to a corresponding one of the radiation boosters, wherein the radiating system is configured to operate in more than one frequency band.

10. The wireless device of claim 9, wherein the conductive branches comprise conductive strips.

11. The wireless device of claim 9, wherein the radiofrequency system comprises a filter disposed within the branch structure.

12. The wireless device of claim 9, wherein the multi-structure antenna system comprises first and second conductive branches and first and second radiation boosters respectively configured to operate within a first frequency range from 600 MHz to 1 GHz and within a second frequency range from 1,710 MHz to 3,000 MHz.

13. The wireless device of claim 12, wherein the clearance area extends into a corner of the ground plane layer.

14. The wireless device of claim 9, wherein the multi-structure antenna system comprises three conductive branches and first, second, and third radiation boosters.

15. The wireless device of claim 14, wherein:

the first, second, and third conductive branches have different lengths to facilitate operation in more than one frequency band; and the radiating system is configured to operate within a frequency range of 600 MHz to 3,000 MHz.

16. The wireless device of claim 9, wherein the conductive branches extend from respective different points on the common conductive strip.

* * * * *